US009724814B2

(12) United States Patent
Yoshikane et al.

(10) Patent No.: US 9,724,814 B2
(45) Date of Patent: Aug. 8, 2017

(54) IMPACT TOOL

(71) Applicant: MAKITA CORPORATION, Anjo-Shi (JP)

(72) Inventors: Kiyunobu Yoshikane, Anjo (JP); Yoshitaka Machida, Anjo (JP); Shinji Onoda, Anjo (JP); Hitoshi Iida, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 490 days.

(21) Appl. No.: 14/374,508

(22) PCT Filed: Dec. 7, 2012

(86) PCT No.: PCT/JP2012/081804

§ 371 (c)(1),
(2) Date: Jul. 24, 2014

(87) PCT Pub. No.: WO2013/111460

PCT Pub. Date: Aug. 1, 2013

(65) Prior Publication Data

US 2015/0041170 A1 Feb. 12, 2015

(30) Foreign Application Priority Data

Jan. 26, 2012 (JP) ..... 2012-014080

(51) Int. Cl.
*B25D 11/06* (2006.01)
*B25D 11/00* (2006.01)
(Continued)

(52) U.S. Cl.
CPC ..... *B25D 11/06* (2013.01); *B25D 11/00* (2013.01); *B25D 11/062* (2013.01); *B25D 16/00* (2013.01);
(Continued)

(58) Field of Classification Search
CPC ..... B25D 11/06; B25D 11/062; B25D 9/00; B25D 16/00; B25D 17/04; B25D 17/24
(Continued)

(56) References Cited

U.S. PATENT DOCUMENTS 3,808,904 A * 5/1974 Gotsch ..... B25D 16/00 74/343
3,831,048 A * 8/1974 Wagner ..... F16C 33/20 310/90
(Continued)

FOREIGN PATENT DOCUMENTS

CN 1689763 A 11/2005
CN 101612729 A 12/2009
(Continued)

OTHER PUBLICATIONS

Office Action from the Chinese Patent Office dated Aug. 13, 2015 in counterpart Chinese application No. 201280068043.2, and translation thereof.
(Continued)

*Primary Examiner* — Scott A Smith
(74) *Attorney, Agent, or Firm* — J-Tek Law PLLC; Jeffrey D. Tekanic; Scott T. Wakeman

(57) ABSTRACT

An impact tool performs a processing operation on a workpiece by carrying out an impact operation on a tool bit in a longitudinal axis direction. The impact tool includes a motor having a rotor and a stator, a tool main body housing the motor, a drive shaft parallel to a longitudinal axis of the tool bit and rotatably driven by the motor, and an oscillating member that is supported by the drive shaft and that carries out an oscillating movement in the axial direction of the drive shaft based on the rotational motion of the drive shaft. A tool drive mechanism is coupled to the oscillating member so that the oscillating movement of the oscillating member linearly moves the tool bit in the longitudinal axis direction.
(Continued)

The motor is an outer rotor motor in which the rotor is disposed on an radially outer side of the stator.

20 Claims, 9 Drawing Sheets

(51) Int. Cl.
*B25D 17/24* (2006.01)
*B25D 16/00* (2006.01)

(52) U.S. Cl.
CPC ..... *B25D 17/24* (2013.01); *B25D 2211/003* (2013.01); *B25D 2211/006* (2013.01); *B25D 2217/0092* (2013.01); *B25D 2250/095* (2013.01)

(58) Field of Classification Search
USPC ..... 173/48, 104, 109, 216, 217, 201, 11, 173/162.1, 162.2, 114, 210
See application file for complete search history.

(56) References Cited

U.S. PATENT DOCUMENTS

| | | | | |
|---|---|---|---|---|
| 4,183,414 | A * | 1/1980 | Tamai | B25D 17/26 173/118 |
| 4,523,116 | A * | 6/1985 | Dibbern, Jr. | H01H 9/063 200/8 R |
| 5,568,849 | A | 10/1996 | Sasaki et al. | |
| 5,692,574 | A * | 12/1997 | Terada | B25F 5/006 173/162.2 |
| 5,842,527 | A * | 12/1998 | Arakawa | B25D 16/006 173/104 |
| 6,066,033 | A | 5/2000 | Kamiya et al. | |
| 6,109,366 | A | 8/2000 | Jansson et al. | |
| 6,739,406 | B2 * | 5/2004 | Lebisch | B25D 17/26 173/104 |
| 6,880,223 | B2 * | 4/2005 | Bednar | B25F 5/00 177/213 |
| 7,410,009 | B2 * | 8/2008 | Hirayama | B25F 5/00 173/104 |
| 8,167,054 | B2 | 5/2012 | Nakashima et al. | |
| 8,210,277 | B2 * | 7/2012 | Umeda | B25F 5/02 173/171 |
| 8,485,274 | B2 | 7/2013 | Ikuta et al. | |
| 2005/0236168 | A1 | 10/2005 | Lennartz | |
| 2006/0086513 | A1 | 4/2006 | Hashimoto et al. | |
| 2009/0133893 | A1 | 5/2009 | Zhong et al. | |
| 2009/0133894 | A1 | 5/2009 | Mizuhara | |
| 2009/0200054 | A1 | 8/2009 | Lennartz | |
| 2009/0321101 | A1 | 12/2009 | Furusawa et al. | |
| 2010/0000751 | A1 * | 1/2010 | Aoki | B25D 17/24 173/114 |
| 2011/0024146 | A1 | 2/2011 | Katou et al. | |
| 2011/0088922 | A1 | 4/2011 | Hirayama et al. | |

FOREIGN PATENT DOCUMENTS

| | | | |
|---|---|---|---|
| CN | 101623861 | A | 1/2010 |
| CN | 102105273 | A | 6/2011 |
| CN | 201900631 | U | 7/2011 |
| CN | 102267129 | A | 12/2011 |
| DE | 102006031745 | A1 | 9/2007 |
| DE | 102008054458 | A1 | 6/2010 |
| EP | 2314420 | A1 | 4/2011 |
| JP | S59232774 | A | 12/1984 |
| JP | S63123678 | A | 5/1988 |
| JP | H07214476 | A | 8/1995 |
| JP | H10329055 | A | 12/1998 |
| JP | H11320455 | A | 11/1999 |
| JP | 2004046023 | A | 2/2004 |
| JP | 2005040880 | A | 2/2005 |
| JP | 2005305647 | A | 11/2005 |
| JP | 2006123023 | A | 5/2006 |
| JP | 2007007832 | A | 1/2007 |
| JP | 2007098562 | A | 4/2007 |
| JP | 2007215308 | A | 8/2007 |
| JP | 2008264905 | A | 11/2008 |
| JP | 2010005751 | A | 1/2010 |
| JP | 2010012586 | A | 1/2010 |
| JP | 201188233 | | 5/2011 |
| JP | 2011224754 | | 10/2011 |
| WO | 2011132514 | A1 | 10/2011 |

OTHER PUBLICATIONS

Office Action from the Chinese Patent Office dated Feb. 2, 2016 in counterpart Chinese application No. 201280068043.2, and translation thereof.
Office Action mailed Jan. 14, 2015 in counterpart Japanese patent application No. 2012-014080, including English translation of substantive portions thereof.
International Search Report from PCT/JP2012/081804.
Written Opinion from PCT/JP2012/081804.
International Search Report from co-pending application PCT/JP2012/083590.
US claims from US National Stage Entry of PCT/JP2012/083590 (U.S. Appl. No. 14/369,258).
Office Action from the Chinese Patent Office dated Mar. 17, 2015 in counterpart Chinese application No. 2012800680432, and translation of substantive portions thereof.
Office Action from the Japanese Patent Office dated May 11, 2015 in counterpart Japanese application No. 2012-014080, and translation thereof.

* cited by examiner

IMPACT TOOL

CROSS-REFERENCE

This application is the U.S. National Stage of International Application No. PCT/JP2012/081804 filed on Dec. 7, 2012, which claims priority to Japanese patent application no. 2012-014080 filed on Jan. 26, 2012.

TECHNICAL FIELD

The present invention relates to an impact tool that performs a prescribed processing operation on a workpiece by linearly driving a tool bit using an oscillating mechanism.

BACKGROUND ART

Japanese Laid-Open Patent Publication No. 2007-7832 discloses a swash bearing-type, power hammer drill that linearly drives a tool bit using an oscillating mechanism. The power hammer drill mentioned in the above publication, which serves as an impact tool, comprises a swash bearing-type oscillating mechanism that principally comprises: a rotary body, which is rotatably driven by an electric motor, and an oscillating member that carries out an oscillating movement in the longitudinal axis direction of the tool bit as the rotary body rotates. The power hammer drill is configured such that the rotational output of the electric motor is converted by the oscillating mechanism into linear motion that then linearly drives the tool bit. An inner rotor-type motor, which comprises a stator and a rotor disposed on the inner side of the stator, is used as the electric motor; a speed reducing mechanism reduces the rotational speed of the motor, and that rotation is transmitted to the rotary body.

The swash bearing type oscillating mechanism configured as described above is used in relatively compact hammer drills; however, in the case of such compact power hammer drills, there is a strong demand to improve the ease of operation by making the tool body lightweight.

SUMMARY OF THE INVENTION

The present invention considers the above, and an object of the present invention is to provide an impact tool that is both lightweight and effective at improving the ease of operation.

To solve the aforementioned problem, an impact tool that performs a prescribed processing operation on a workpiece by carrying out an impact operation on a tool bit in a longitudinal direction is configured according to a preferable aspect of the present invention. The impact tool comprises: a motor, which comprises a rotor and a stator; a tool main body, which houses the motor; a drive shaft, which is disposed parallel to the longitudinal axis of the tool bit and is rotatably driven by the motor; an oscillating member, which is supported by the drive shaft and carries out an oscillating movement in the axial direction of the drive shaft based on the rotational movement of the drive shaft; and a tool drive mechanism, which is coupled to the oscillating member and linearly moves the tool bit in the longitudinal axis direction by the oscillating movement of the oscillating member, thereby linearly driving the tool bit. Furthermore, the motor is configured as an outer rotor type motor in which the rotor is disposed on an outer side of the stator.

According to the present invention, an outer rotor type motor, in which the rotor is disposed on the outer side of the stator, is used as the motor; this makes it possible to form the rotating portion of the motor with a large outer diameter, thereby providing the drive motor with a large rotor moment of inertia. Consequently, as compared to impact tools that use an inner rotor type motor, a large torque can be generated. As compared with conventional impact tools, in which an inner rotor type motor, which requires a speed reducing mechanism, is installed between the motor and the drive shaft that is driven by the motor, the present invention is thus effective in making the tool body more compact and lightweight and in improving the ease of operation. In addition, in case the outputs of the motors are constant, then the outer rotor type motor can generate a larger torque than an inner rotor type motor can, and this makes it possible to reduce the rotational speed of the motor. As a result, vibrations of the impact tool due to motor vibrations can be reduced.

According to another aspect of an impact tool according to the present invention, the drive shaft is configured such that it is driven at the same rotational speed as an output shaft of the motor. Furthermore, the phrase "driven at the same rotational speed" in this aspect is not limited to a mode in which they are driven at literally the same rotational speed, and preferably includes a mode in which they are driven at substantially the same rotational speed. In addition, the mode "drive" preferably includes either a mode in which the drive shaft is directly coupled to the output shaft of the motor or a mode in which the drive shaft is indirectly coupled to the output shaft. Furthermore, one conceivable example of an indirectly-coupled mode is a mode in which the drive shaft is coupled to the output shaft via a gear or a belt.

According to another aspect of an impact tool according to the present invention, a first bearing, which rotationally supports the output shaft of the motor, and a second bearing, which rotationally supports the drive shaft, are supported by the tool main body via a single bearing support member.

According to this aspect, a configuration is adopted in which the first bearing and the second bearing are supported by a single bearing support member, and thereby, as compared with the case of a configuration in which the first bearing and the second bearing are supported by separate support members, the axial center accuracy between the drive shaft and the output shaft of the motor can be increased, the part count can be reduced, the structure can be simplified, and the ease of assembly can be improved.

According to another aspect of an impact tool according to the present invention, the output shaft of the motor and the drive shaft are disposed coaxially.

According to this aspect, a configuration is adopted in which the output shaft of the motor and the drive shaft are disposed coaxially, which makes it possible to form a space above the motor along an extension line of the longitudinal axis of the tool bit and to utilize this space as a space for disposing other functional members.

According to another aspect of an impact tool according to the present invention, the longitudinal axis of the tool bit and the drive shaft are disposed in parallel and are spaced apart by a prescribed distance in a direction that intersects the extension direction of the longitudinal axis. Furthermore, at least a portion of a prescribed functional member for the processing operation is disposed on an inner side of a projection range of the motor in a virtual projection plane when viewed from one side of a direction along a straight line that is a straight line along a plane containing both the longitudinal axis of the tool bit and the drive shaft, which straight line intersects the longitudinal axis of the tool bit. Furthermore, the "prescribed functional member for the processing operation" in this aspect typically corresponds to (a) vibration-preventing member(s) that is (are) provided in order to prevent or reduce vibrations in the impact tool operating handle grasped by the operator during the processing operation.

According to this aspect, disposing at least part of the functional member such that it is hidden behind the motor makes it possible to make the outer wall shape compact in the direction orthogonal to the plane that contains both the longitudinal axis of the tool bit and the drive shaft.

According to yet another aspect of the impact tool according to the present invention, the functional member is (a) vibration-preventing mechanism(s) for reducing vibrations of the tool main body. Furthermore, "vibration-preventing mechanism" in this aspect typically corresponds to a damping mechanism, such as a dynamic vibration absorber, a counterweight, etc., that acts to reduce the vibrations of the tool main body.

According to this aspect, providing the vibration-preventing mechanism(s), which reduce(s) vibrations of the tool main body, makes it possible to reduce vibrations of the tool main body during the processing operation and thereby improve the working conditions for the operator.

Another aspect of an impact tool according to the present invention further comprises a handle for the operator to grasp, in which the handle is coupled to the tool main body. Furthermore, the functional member is an elastic body that couples the tool main body and the handle.

According to this aspect, the transmission of vibrations generated in the tool main body to the handle during the processing operation is prevented or reduced and this makes it possible to improve the working conditions for the operator.

According to another aspect of an impact tool according to the present invention, the output shaft of the motor and the drive shaft are arranged in a cross-shape with each other and are coupled by bevel gears.

According to this aspect, it is possible to adopt a configuration wherein, in a side view of the impact tool, the longitudinal axis direction of the output shaft of the motor and the longitudinal axis direction of the tool bit intersect one another, i.e., it is possible to configure the impact tool such that the tool bit and the motor are disposed in an L-shape.

The present invention provides an impact tool that is both lightweight and effective at improving the ease of operation.

The operation and effects of other features of the present invention will be readily understandable by referring to the present specification, the claims, and the attached drawings.

DETAILED DESCRIPTION

The configurations and the methods according to the text recited above and below can be used separately from or in combination with other configurations and methods that manufacture and use an "impact tool" according to the present invention or implement the use of constituent elements of the "impact tool." The representative embodiments of the present invention incorporate these combinations, and the details thereof are explained while referencing the attached drawings. The detailed information below is limited to teaching detailed information for implementing preferred application examples of the present invention to a person skilled in the art, and the technical scope of the present invention is not limited to such detailed description, but rather is prescribed based on the text of the claims. Consequently, in a broader sense, the combinations of configurations, method steps, and the like in the detailed description below are not all necessarily essential for implementing the present invention; furthermore, the recited detailed description, together with the reference numbers in the attached drawings, merely disclose representative embodiments of the present invention.

First Embodiment of the Present Invention

Figure 1:
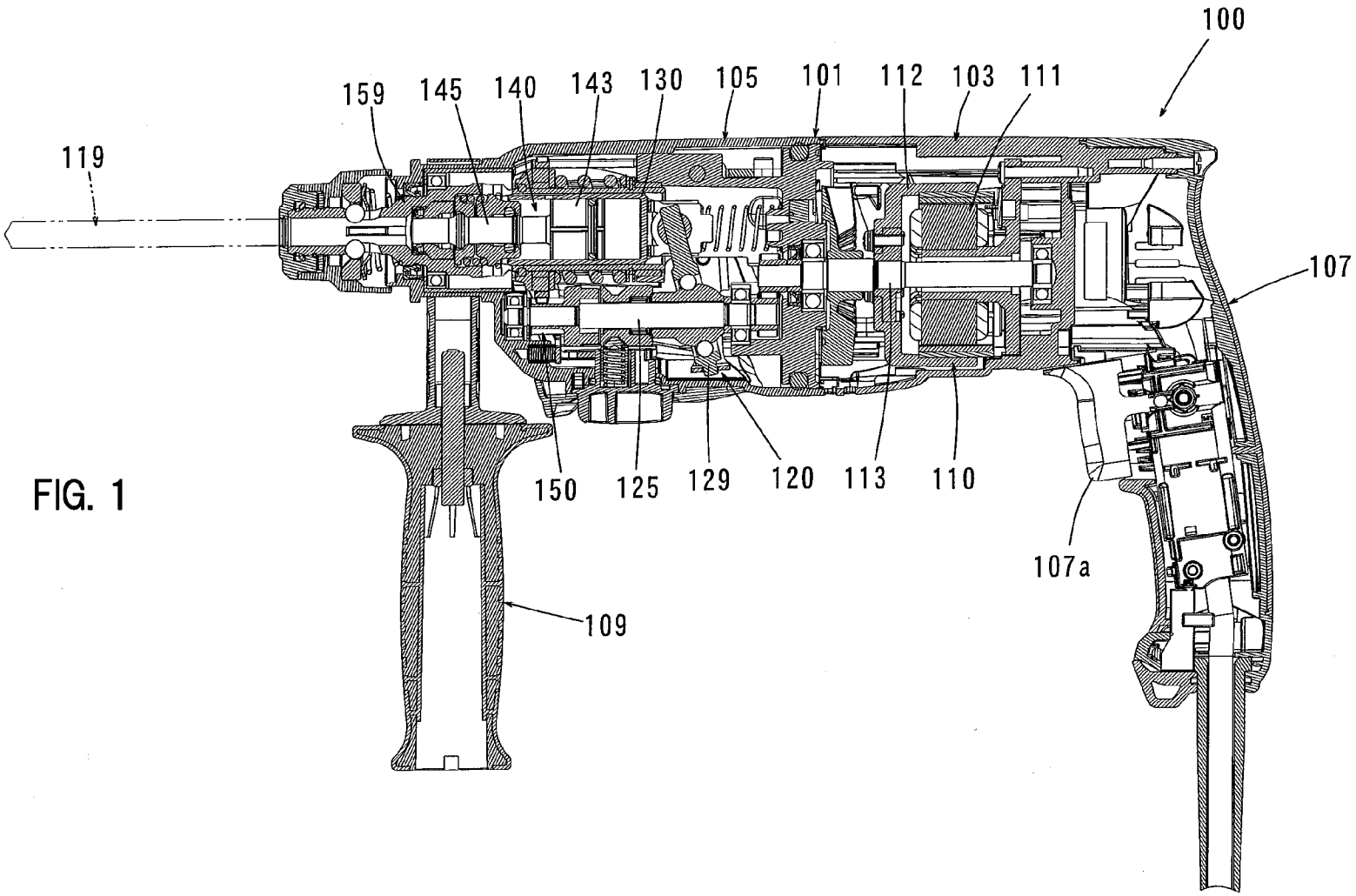
FIG. 1 is a cross sectional view that shows the configuration of a power hammer drill according to a first embodiment.

A first embodiment of the present invention is explained in detail below while referencing FIG. 1 and FIG. 2. The embodiments of the present invention are explained using a power hammer drill as one representative, non-limiting example of an impact tool. In general, as shown in FIG. 1, a power hammer drill 100 principally comprises a main body part 101 that forms the outer wall of the power hammer drill 100. A hammer bit 119 is attachably and detachably mounted at a tip area of the main body part 101 via a cylindrical tool holder 159. The hammer bit 119 is mounted on the tool holder 159 such that the hammer bit 119 can move relative to the tool holder 159 in the axial direction and rotate integrally with the tool holder 159 in the circumferential direction. A hand grip 107, which the operator grasps, is connected to an end part of the main body part 101 on the side opposite the tip area. The hand grip 107 extends from the end part of the main body part 101 in an intersection direction of the longitudinal axis direction of the main body part 101 (the longitudinal axis direction of the hammer bit 119), such that the hammer drill 100 has the overall appearance of a pistol-type hammer drill. In addition, a side grip 109, which serves as an auxiliary handle, is removably mounted on the main body part 101 at the tip area side, and the operator performs the processing operation by gripping the hand grip 107 and the side grip 109 and operating the power hammer drill 100.

The main body part 101 is one example of an implementation configuration that corresponds to a "tool main body" of the present invention, the hammer bit 119 is one example of an implementation configuration that corresponds to a "tool bit" of the present invention, and the hand grip 107 is one example of an implementation configuration that corresponds to a "handle" of the present invention. Furthermore, in the present embodiment, for the sake of convenience, the hammer bit 119 side of the main body part 101 in the longitudinal axis direction is defined as the "front side" or the "frontward side," and the hand grip 107 side is defined as the "rear side" or the "rearward side." In addition, the page upper direction of FIG. 1 is defined as the "upper side" or the "upward side," and the page downward direction is defined as the "lower side" or the "downward side."

The main body part 101 principally comprises: a motor housing 103, which houses an electric motor 110, and a gear housing 105, which houses a motion converting mechanism 120, an impact element 140, and a power transmitting mechanism 150. The electric motor 110 is one example of an implementation configuration that corresponds to a "motor" of the present invention. The rotational output of the electric motor 110 is suitably converted into linear motion by the motion converting mechanism 120, after which the linear motion is transmitted to the impact element 140. Thereby, an impact force is generated in the longitudinal axis direction (the left and right direction in FIG. 1) of the hammer bit 119 via the impact element 140. In addition, the rotational output of the electric motor 110 is suitably reduced in speed by the power transmitting mechanism 150 and is then transmitted to the hammer bit 119. Thereby, the hammer bit 119 is rotationally moved in the circumferential direction. The electric motor 110 is energized and driven by depressing a trigger 107*a* disposed in the hand grip 107.

Figure 2:
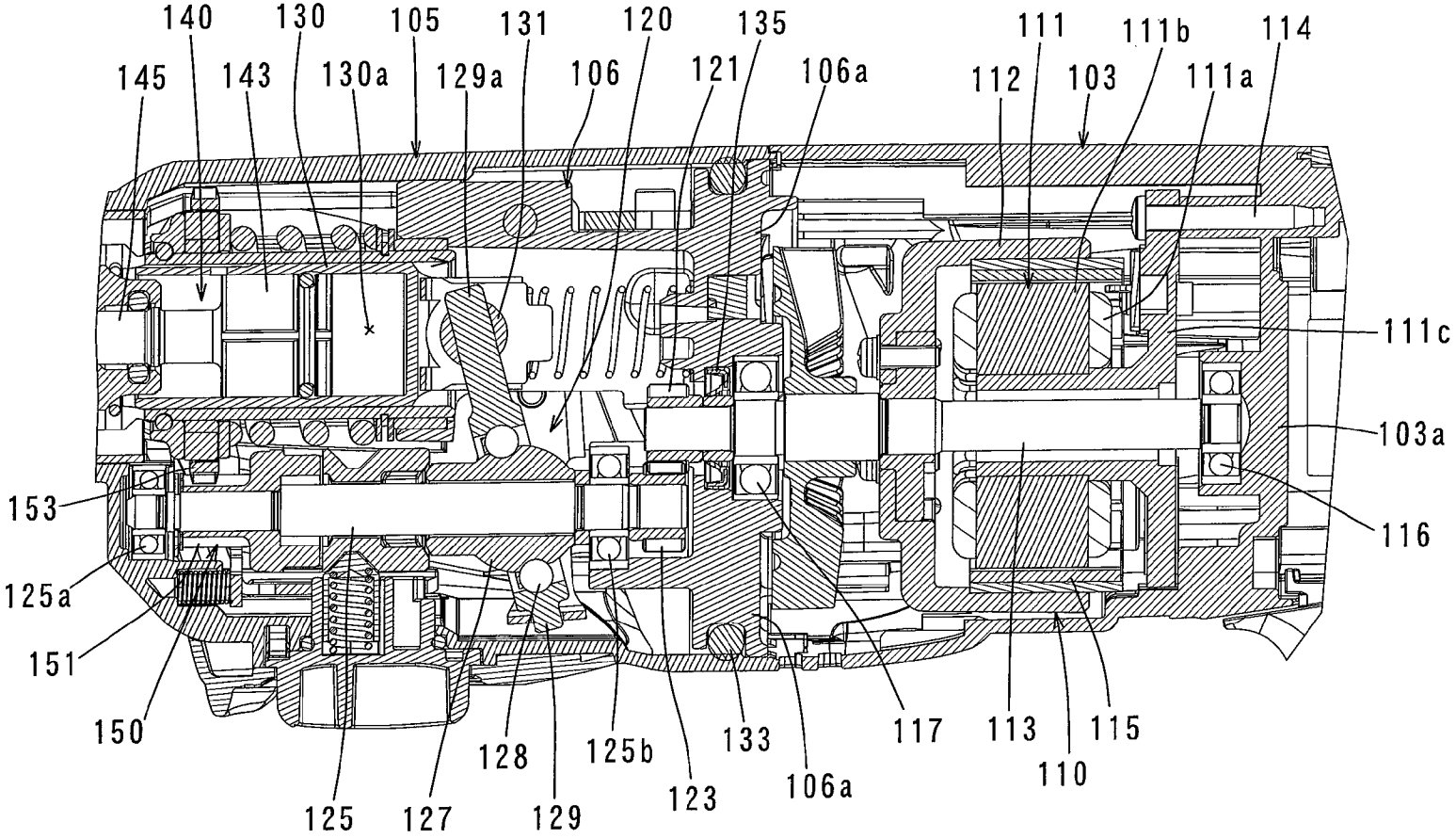
FIG. 2 is an enlarged cross sectional view of the principal parts shown in FIG. 1.

As shown in FIG. 2, the electric motor 110 is configured as an outer rotor type motor in which a stator 111 is disposed on the inner side and a rotor 112 is disposed on the outer side. The electric motor 110 is disposed such that the longitudinal axis direction of the rotor 112 (motor shaft 113) is parallel to the longitudinal axis direction of the hammer bit 119 (thus, the longitudinal axis direction of the main body part 101). The stator 111 principally comprises a substantially circular, annular coil holding member 111*b* and a mounting flange member 111*c*. The coil holding member 111*b* holds a drive coil 111*a* for driving the rotor 112. The mounting flange member 111*c* has a cylindrical part for supporting the coil holding member 111*b*, and supports the coil holding member 111*b* in that the cylindrical part is press-fit in an annular hole of the coil holding member 111*b*. In addition, a flange portion of the mounting flange member 111*c* is affixed by a screw 114 that is screwed into a rearward vertical wall part 103*a* of the motor housing 103.

The rotor 112 is formed as a substantially cup-shaped member that is integrally and rotatably supported by the motor shaft 113; furthermore, a magnet 115 is attached to an inner circumferential surface of the rotor 112 such that it opposes an outer circumference of the stator 111, and the motor shaft 113 is press-fit affixed in the center of a bottom part of a cup shape. The motor shaft 113 is one example of an implementation configuration that corresponds to an "output shaft" of the present invention. The rear side of the motor shaft 113 passes through a center hole of the mounting flange member 111*c* of the stator 111 so that the motor shaft 113 loosely fits in the center hole and extends rearward therefrom; furthermore, that extended end part is rotationally supported by the rearward vertical wall part 103*a* of the motor housing 103 via a bearing 116 (a ball bearing). In addition, the front side of the motor shaft 113, which extends toward the side of the gear housing 105, is rotationally supported by a vertically-oriented wall part 106*a* of an inner housing 106 via a bearing 117 (a ball bearing), and passes through the vertically-oriented wall part 106*a* of the inner housing 106, and extends into the gear housing 105. A drive gear 121 is attached to that extended end part such that the drive gear 121 rotates integrally therewith. Furthermore, the inner housing 106 is fixedly disposed inside the gear housing 105.

The motion converting mechanism 120 principally comprises: the drive gear 121 that is rotatably driven by the electric motor 110 in a vertical plane; a driven gear 123 that meshes with and thereby engages the drive gear 121; an intermediate shaft 125 that rotates integrally with the driven gear 123; a rotary body 127 that rotates integrally with the intermediate shaft 125; a substantially annular oscillating ring 129 that oscillates in the longitudinal axis direction of the hammer bit 119 due to the rotation of the rotary body 127; and a cylindrical piston 130 having a bottomed cylinder that is reciprocally linearly moved due to the oscillation of the oscillating ring 129. The intermediate shaft 125 is one example of an implementation configuration that corresponds to a "drive shaft" of the present invention, and the oscillating ring 129 is one example of an implementation configuration that corresponds to an "oscillating member" of the present invention. The drive gear 121 and the driven gear 123 are configured such that they transmit rotation from the motor shaft 113 to the intermediate shaft 125 at a uniform speed and the intermediate shaft 125 can be driven at the same rotational speed as the motor shaft 113.

The drive gear 121 is attached to a front side end part of the motor shaft 113 and rotates integrally with the motor shaft 113. The intermediate shaft 125 is disposed parallel to the longitudinal axis direction of the hammer bit 119 (thus, parallel to the motor shaft 113). In addition, the intermediate shaft 125 is rotationally supported at its front end part by the gear housing 105 via a bearing 125*a* (a ball bearing), and is rotationally supported at its rear end part by the vertically-oriented wall part 106*a* of the inner housing 106 via a bearing 125*b* (a ball bearing). That is, the bearing 117, which supports the front end part of the motor shaft 113, and the bearing 125*b*, which supports the rear end part of the intermediate shaft 125, are supported by the gear housing 105 via the inner housing 106, which functions as a single member, and, more specifically, via the vertically-oriented wall part 106*a*. Furthermore, the motor shaft 113 is supported between an axis line of the intermediate shaft 125 and an extension line of the hammer bit 119 in the axial direction and is disposed rearward of the intermediate shaft 125. The vertically-oriented wall part 106*a* of the inner housing 106 is one example of an implementation configuration that corresponds to a "single bearing support member" of the present invention, the bearing 117 is one example of an implementation configuration that corresponds to a "first bearing" of the present invention, and the bearing 125*b* is one example of an implementation configuration that corresponds to a "second bearing" of the present invention.

In addition, the vertically-oriented wall part 106*a* of the inner housing 106 also functions as a member that partitions the internal space of the motor housing 103 from the internal space of the gear housing 105. An O-ring 133 is interposed between an inner wall surface of the gear housing 105 and an outer circumferential surface of the vertically-oriented wall part 106*a*, and an oil seal 135 is interposed between the vertically-oriented wall part 106*a* and the motor shaft 113. In this manner, leakage of lubricating oil, which fills the interior of the gear housing 105, to the motor housing 103 side is prevented.

A groove, which is tilted at a prescribed tilt angle with respect to the axis line of the intermediate shaft 125, is formed in the outer circumferential surface of the rotary body 127 that is attached to the intermediate shaft 125. The oscillating ring 129 is fitted onto and rotatably supported by the rotary body 127 via balls 128, which serve as rolling elements. Furthermore, the balls 128 roll in the groove of the rotary body 127. In addition, as the rotary body 127 rotates, the oscillating ring 129 oscillates in the longitudinal axis direction of the hammer bit 119. A columnar oscillating rod 129*a* is provided in an upper end part area of the oscillating ring 129 such that it protrudes in the radial direction (upward direction). The oscillating rod 129*a* is inserted in the radial direction through a coupling shaft 131 that is provided at a rear end part of the cylindrical piston 130, such that the oscillating rod 129*a* loosely fits in the coupling shaft 131. In this manner, the oscillating ring 129 is configured so that it is coupled to the cylindrical piston 130 via the oscillating rod 129*a* and the coupling shaft 131. Furthermore, the coupling shaft 131 is rotatably mounted about a horizontal axis line that intersects the longitudinal axis of the hammer bit 119. The swash bearing-type oscillating mechanism is configured by the oscillating ring 129, the balls 128 and the rotary body 127, which rotates integrally with the intermediate shaft 125.

The cylindrical piston 130 is slidably disposed inside a rearward cylindrical part of the tool holder 159, is linked to the oscillating motion of the oscillating ring 129 (the longitudinal axis direction component of the hammer bit 119), and moves linearly along the inner wall of the bore of the tool holder 159. An air chamber 130*a*, which is partitioned by a below-described striker 143, is formed on the inner side of the cylindrical piston 130.

The impact element 140 principally comprises a striker 143, which serves as a hammer, and an impact bolt 145, which serves as an intermediate element. The striker 143 is disposed so as to freely slide along the inner wall of the bore of the cylindrical piston 130. The striker 143 is driven by the pressure fluctuations of the air chamber 130*a* (air spring) caused by the sliding movement of the cylindrical piston 130 and thereby collides with (impacts) the impact bolt 145. The impact bolt 145 is disposed so as to freely slide inside a frontward tube part of the tool holder 159 and transmits the movement energy (the impact force) of the striker 143 to the hammer bit 119. The cylindrical piston 130, the striker 143, and the impact bolt 145 constitute a "tool drive mechanism" of the present invention.

The power transmitting mechanism 150 principally comprises a first transmitting gear 151, a second transmitting gear 153, and a tool holder 159 serving as the final shaft. The first transmitting gear 151 is disposed on the side of the intermediate shaft 125 opposite to the driven gear 123 such that the oscillating ring 129 is sandwiched by the first transmitting gear 151 and the driven gear 123. The second transmitting gear 153 meshes with and engages the first transmitting gear 151 and thereby rotates around the longitudinal axis directions of the hammer bit 119. The tool holder 159 rotates, together with the second transmitting gear 153, coaxially around the longitudinal axis direction of the hammer bit 119. In addition, the tool holder 159 is a substantially circular cylindrical-shaped, cylinder member and is held by the gear housing 105 such that it is rotates freely around the longitudinal axis of the hammer bit 119. Furthermore, the tool holder 159 comprises: a frontward tube part that houses and holds a shaft part of the hammer bit 119 and the impact bolt 145; and a rearward tube part that extends integrally and rearward from the frontward tube part and slidably houses and holds the cylindrical piston 130.

The thus-configured power transmitting mechanism 150 transmits the rotational output of the intermediate shaft 125, which is rotatably driven by the electric motor 110, from the first transmitting gear 151 to the tool holder 159 and to the hammer bit 119 via the second transmitting gear 153.

In the power hammer drill 100 configured as described above, when the electric motor 110 is energized and driven by a user by depressing the trigger 107*a* and the rotary body 127 is thereby rotatably driven together with the intermediate shaft 125, the oscillating ring 129 oscillates in the longitudinal axis direction of the hammer bit 119. The cylindrical piston 130 in turn oscillates linearly inside the tool holder 159. Furthermore, the pressure fluctuations of the air inside the air chamber 130*a* caused by the oscillating movement of the cylindrical piston 130 cause the striker 143 to move linearly inside the cylindrical piston 130. The striker 143 collides with the impact bolt 145, and its kinetic energy is transmitted to the hammer bit 119.

Moreover, when the first transmitting gear 151 rotates together with the intermediate shaft 125, the tool holder 159 rotates in a vertical plane via the first transmitting gear 151 and the second transmitting gear 153 and, furthermore, the hammer bit 119, which is held by the tool holder 159, rotates integrally therewith. Thus, the hammer bit 119 operates as a hammer in the axial direction and as a drill in the circumferential direction, and in this manner performs the work of drilling the workpiece (concrete).

In the present embodiment, the electric motor 110 is configured as an outer rotor type motor in which the rotor 112 is disposed on the outer side of the stator 111. Adopting an outer rotor type motor makes it possible to form the rotor 112 with a large outer diameter, and thus provide the rotor with a large moment of inertia. Consequently, as compared with an inner rotor type motor, a large torque can be generated. If instead the electric motor were an inner rotor type motor, then a speed reducing mechanism would have to be provided between the motor shaft and the intermediate shaft in order to ensure the torque necessary to generate the prescribed impact force, and consequently the weight or size of the tool body might increase. However, according to the present embodiment, configuring the electric motor 110 as an outer rotor type motor makes it possible to make the tool body compact and lightweight and, thereby, to improve the ease of operation of the power hammer drill 100 when performing a processing operation. In addition, if the output of the electric motor 110 is constant, then the rotational speed can be reduced, and this makes it possible to reduce the vibrations of the power hammer drill 100 caused by motor vibrations, and makes it unnecessary to take measures to deal with resonance, and makes it possible to increase the durability of the bearings 116, 117.

In addition, in the present embodiment, the bearing 116, which receives the rear end part of the motor shaft 113, is configured such that it is directly supported by the rearward vertically-oriented wall part 103*a* of the motor housing 103. In this configuration, if the rotational speed of the motor shaft 113 is high, there is a possibility that the motor housing 103 will resonate; therefore, in conventional power hammer drills, a configuration is adopted in which the bearing 116 is supported by the motor housing 103 via an elastic body. However, according to the present embodiment, configuring the electric motor 110 as an outer rotor type motor makes it possible to reduce the rotational speed of the motor shaft 113, and consequently resonance is reduced, even though the motor housing 103 directly supports the bearing 116 without an intervening elastic body. Thereby, the part count can be reduced and the structure can be simplified.

In addition, according to the present embodiment, the bearing 117, which rotationally supports the front end part of the motor shaft 113, and the bearing 125*b*, which rotationally supports the rear end part of the intermediate shaft 125, are supported by the vertically-oriented wall part 106*a* of the inner housing 106. That is, a configuration is adopted in which the bearings 117 and 125*b*, which have two different axes, are supported by a single member, i.e. the vertically-oriented wall part 106*a*. Consequently, as compared with the case in which the motor shaft bearing 117 and the intermediate shaft bearing 125*b* are individually supported by separate support members, the axial center accuracy between the axes of the motor shaft 113 and the intermediate shaft 125 can be increased, the part count can be reduced, the structure can be simplified, and the ease of assembly can be improved.

Second Embodiment of the Present Invention

Figure 3:
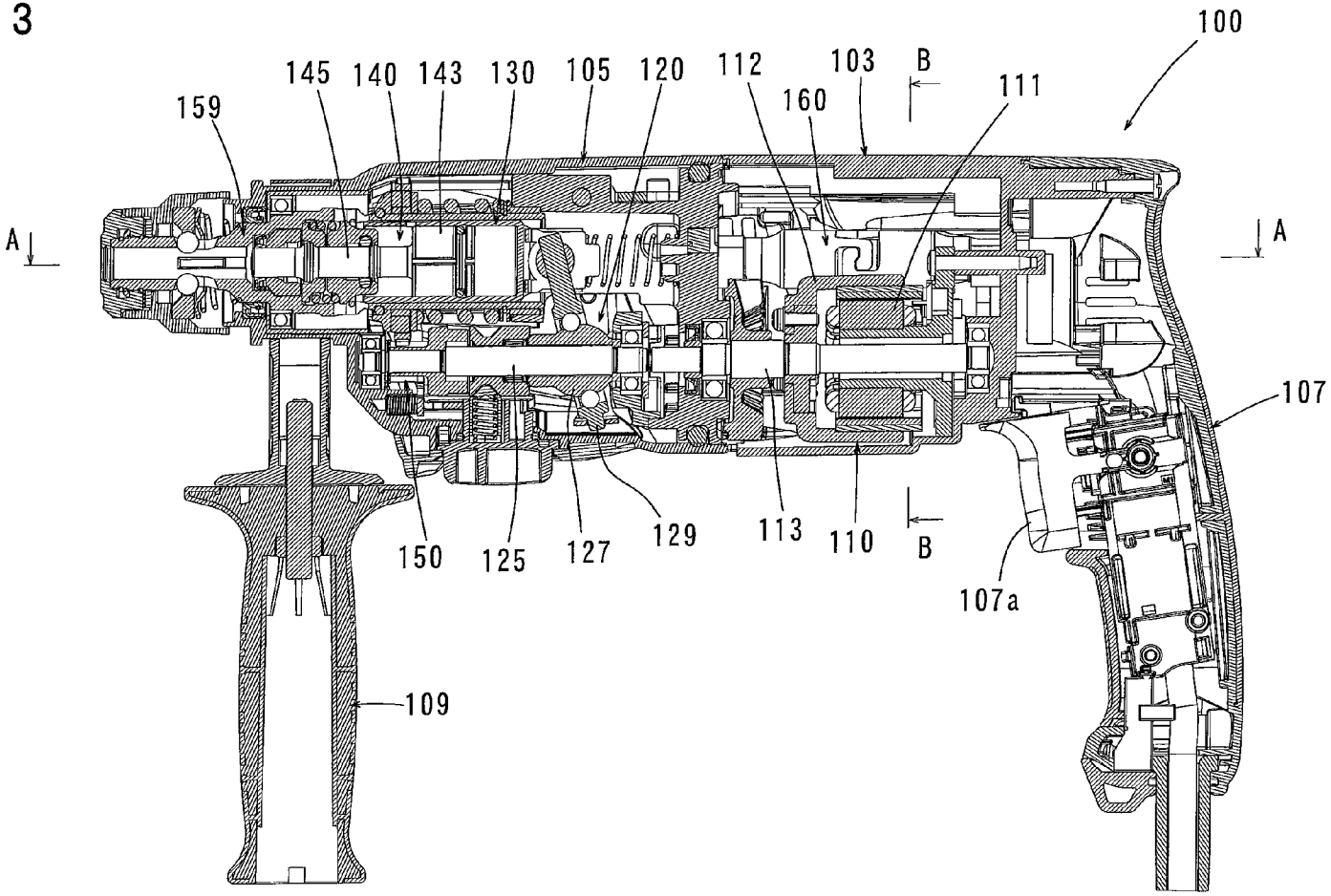
FIG. 3 is a cross sectional view that shows the configuration of a power hammer drill according to a second embodiment.

Next, a second embodiment of the present invention will be explained while referencing FIG. 3 through FIG. 5. As shown in FIG. 3, the power hammer drill 100 according to the present embodiment is configured such that the motor shaft 113 of the electric motor 110 and the intermediate shaft 125 of the motion converting mechanism 120 are coaxial and are directly coupled (i.e. directly coupled to one another). The motor shaft 113 and the intermediate shaft 125, which are coaxial, have shaft end surfaces that oppose one another; furthermore, a square hole is formed in one of the shaft end surfaces, a square shaft is formed in the other shaft end surface, and the square hole and the square shaft are fitted and thereby coupled to one another such that they are capable of transmitting motive power. Furthermore, the means for coupling the motor shaft 113 and the intermediate shaft 125 is not limited to fitting them to one another, and modifications such as coupling by screws or press fitting or coupling via an intermediate member such as a connector are also possible.

In the present embodiment, the motor shaft 113 is directly coupled coaxially to the intermediate shaft 125, and consequently the position at which the electric motor 110 is disposed is lower than in the case of the first embodiment discussed above. Thereby, inside the motor housing 103, an empty area (space) can be formed above the electric motor 110 and in the rearward direction of the extension line of the axis line of the hammer bit 119, i.e. in the rearward direction of the impact axis line. In the present embodiment, a configuration is adopted in which dynamic vibration absorbers 160 are installed by utilizing that empty area. The dynamic vibration absorbers 160 are one example of an implementation configuration that corresponds to a "prescribed functional member for a processing operation" of the present invention. Furthermore, constituent elements other than those mentioned above—namely, the configurations of the motion converting mechanism 120, the impact element 140, and the power transmitting mechanism 150, as well as the configuration of the electric motor 110 as an outer rotor type motor—are the same as those in the first embodiment discussed above. Consequently, the same symbols as those in the first embodiment are assigned, and explanations thereof are therefore omitted or simplified.

Figure 4:
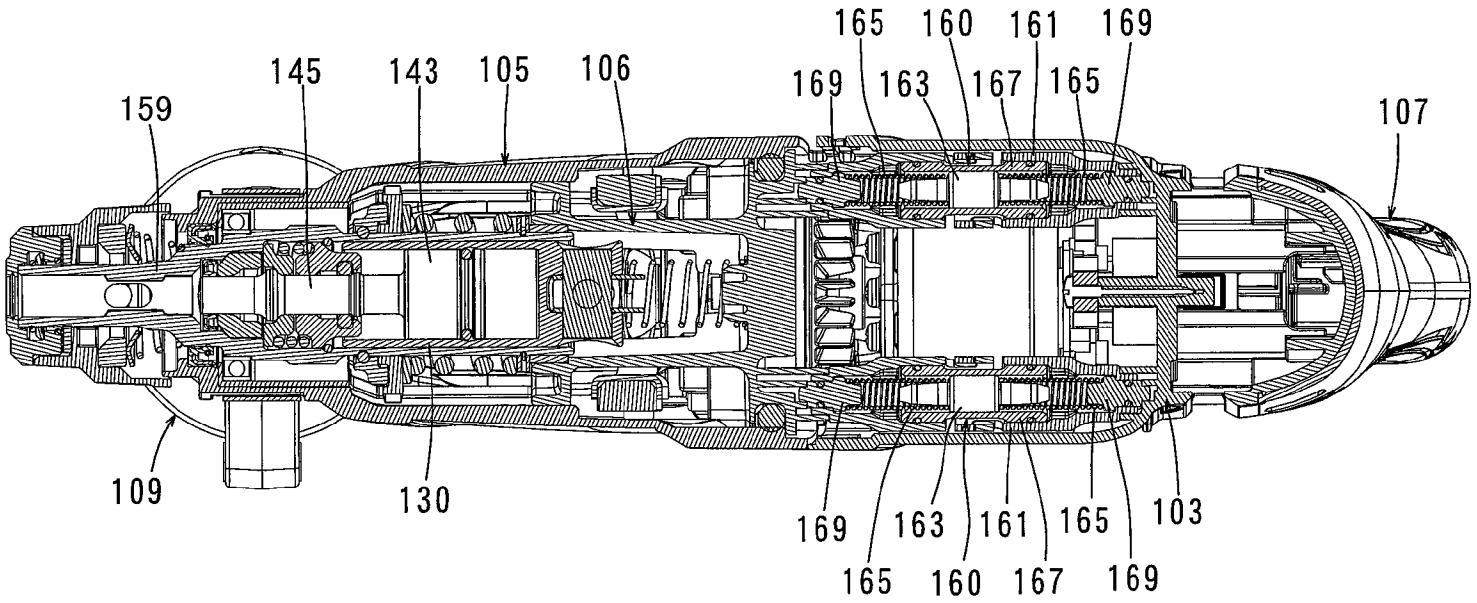
FIG. 4 is a cross sectional view taken along the A-A line in FIG. 3.
Figure 5:
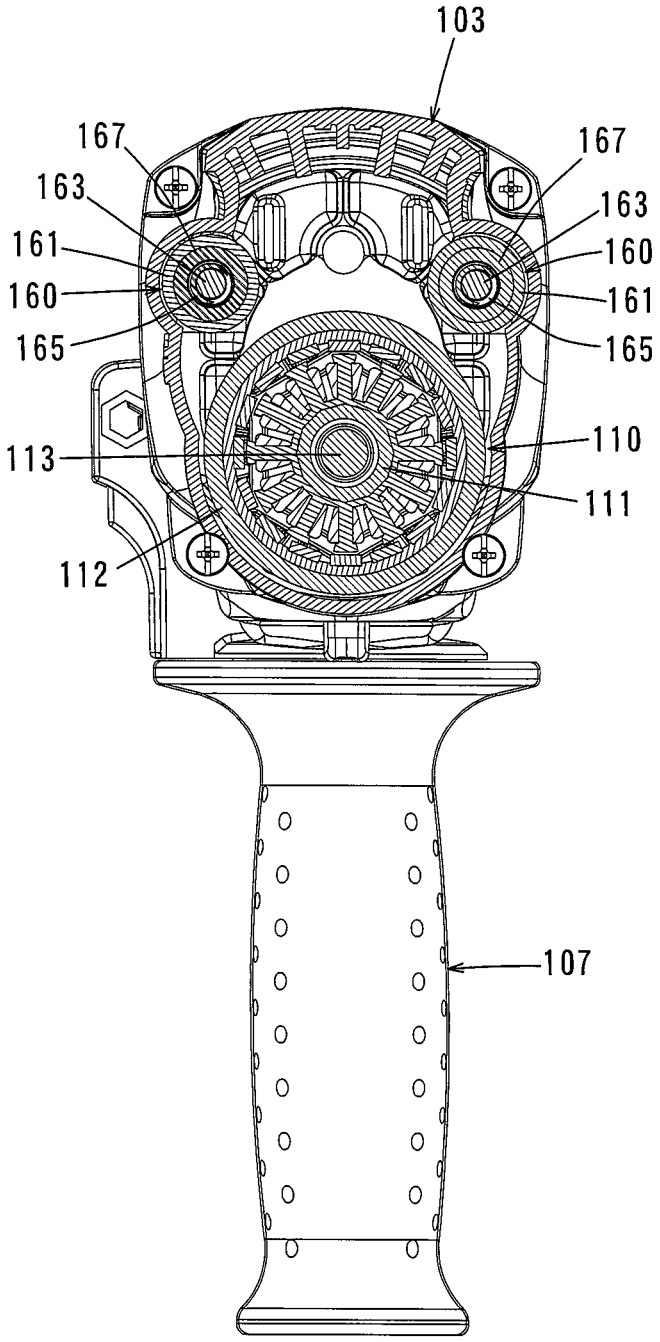
FIG. 5 is a cross sectional view taken along the B-B line in FIG. 3.

As shown in FIG. 4 and FIG. 5, the dynamic vibration absorbers 160 are disposed in the lateral areas on the left side and right side of the empty area, i.e. at upward diagonal positions as viewed from the center position of the electric motor 110, and along a horizontal axis line that is transverse to the axis line of the hammer bit 119, and are housed in the internal space of the motor housing 103. The left and right dynamic vibration absorbers 160 have a common structure.

As shown in FIG. 4, each of the dynamic vibration absorbers 160 principally comprises: a cylindrical body 161; a substantially columnar weight 163; urging springs 165 that serve as elastic elements; a guide sleeve 167 that guides the weight 163; and spring retainers 169. The cylindrical body 161 is formed such that it extends parallel to the longitudinal axis direction of the hammer bit 119. The weight 163 is slidably disposed inside the cylindrical body 161. The urging springs 165 are disposed inside the cylindrical body 161 frontward and rearward of the weight 163 in the longitudinal axis direction of the hammer bit 119 so as to impart elastic forces to the weight 163. One of the spring retainers 169 is disposed at one end of the front urging spring 165, and the other spring retainer 169 is disposed at one end of the rear urging spring 165; furthermore, each of the spring retainers 169 is disposed such that it supports the end part of its corresponding urging spring 165 on the side opposite the weight 163 side in the longitudinal axis direction of the hammer bit 119. Furthermore, the guide sleeve 167 is provided as a circular cylindrical member that ensures reliable sliding movement of the weight 163, and it is fitted into a cylindrical hole of the cylindrical body 161.

According to the dynamic vibration absorbers 160 described above, when the power hammer drill 100 is performing the processing operation, the weights 163 and the urging springs 165, which are damping elements, cooperate with the main body part 101, which is the damping target, to perform passive damping. In this manner, it is possible to suppress vibrations that arise in the main body part 101.

According to the present embodiment configured as described above, installing the outer rotor type motor as the electric motor 110 makes it possible, as in the first embodiment discussed above, to make the tool body compact and lightweight and to thereby achieve operational effects such as improved ease of operation. In particular, in the present embodiment, a configuration is adopted, in which an empty area is formed inside the motor housing 103 upward of the electric motor 110 and in the rearward direction of the impact axis line, by disposing the motor shaft 113 of the electric motor 110 coaxially with the intermediate shaft 125 of the motion converting mechanism 120; dynamic vibration absorbers 160 are disposed, in a side view, along the impact axis line in the empty area. Consequently, during a processing operation, the dynamic vibration absorbers 160 can efficiently reduce vibrations in the main body part 101, and thus the working conditions when the operator grasps the hand grip 107 and operates the power hammer drill 100 can be improved.

In addition, in the present embodiment, when the dynamic vibration absorbers 160 are to be housed and thereby disposed in the upper empty area inside the motor housing 103, the dynamic vibration absorbers 160 are disposed such that at least a portion of each is located in a range that, when viewing the power hammer drill 100 from below and transverse to the longitudinal axis direction of the hammer bit 119 in FIG. 5, is not visible due to the electric motor 110. That is, a configuration is adopted in which a portion of each of the dynamic vibration absorbers 160 is disposed such that it is hidden behind the electric motor 110. Here, in the present embodiment, because an outer rotor type motor of the type, which directly disposes the stator 111 and the rotor 112 inside the motor housing 103, is used as the electric motor 110, the dynamic vibration absorbers 160 are disposed such that they are hidden behind the rotor 112 of the electric motor 110. Furthermore, the dynamic vibration absorbers 160 are preferably disposed such that they are substantially entirely behind the electric motor 110. By disposing the dynamic vibration absorbers 160 in this manner, it is possible to make the outer wall shape more compact in the direction orthogonal to a plane that includes both the axis line of the hammer bit 119 and the axis line of the motor shaft 113, even though it is a configuration that installs dynamic vibration absorbers 160. Furthermore, a configuration may also be adopted in which at least a portion of each of the dynamic vibration absorbers 160 is disposed such that it is located in a range that is not visible due to the electric motor 110 when the power hammer drill 100 is viewed from the side, which is in a direction along a straight line that is orthogonal to a plane that includes both the axis line of the hammer bit 119 and the axis line of the motor shaft 113, the straight line intersecting the axis line of the hammer bit 119; that is, a portion of each of the dynamic vibration absorbers 160 is disposed such that it is hidden behind the electric motor 110. Furthermore, in such a case, substantially the entirety of each of the dynamic vibration absorbers 160 is preferably disposed such that it is hidden behind the electric motor 110. Adopting such a configuration makes it possible to make the outer wall shape more compact even in the direction orthogonal to both the axis line of the hammer bit 119 and the axis line of the motor shaft 113.

In addition, in the present embodiment, the motor shaft 113 and the intermediate shaft 125 are configured as a directly coupled structure, and this makes it possible to prevent noise that arises due to backlash when motive power is transmitted via the gears.

Third Embodiment of the Present Invention

Figure 6:
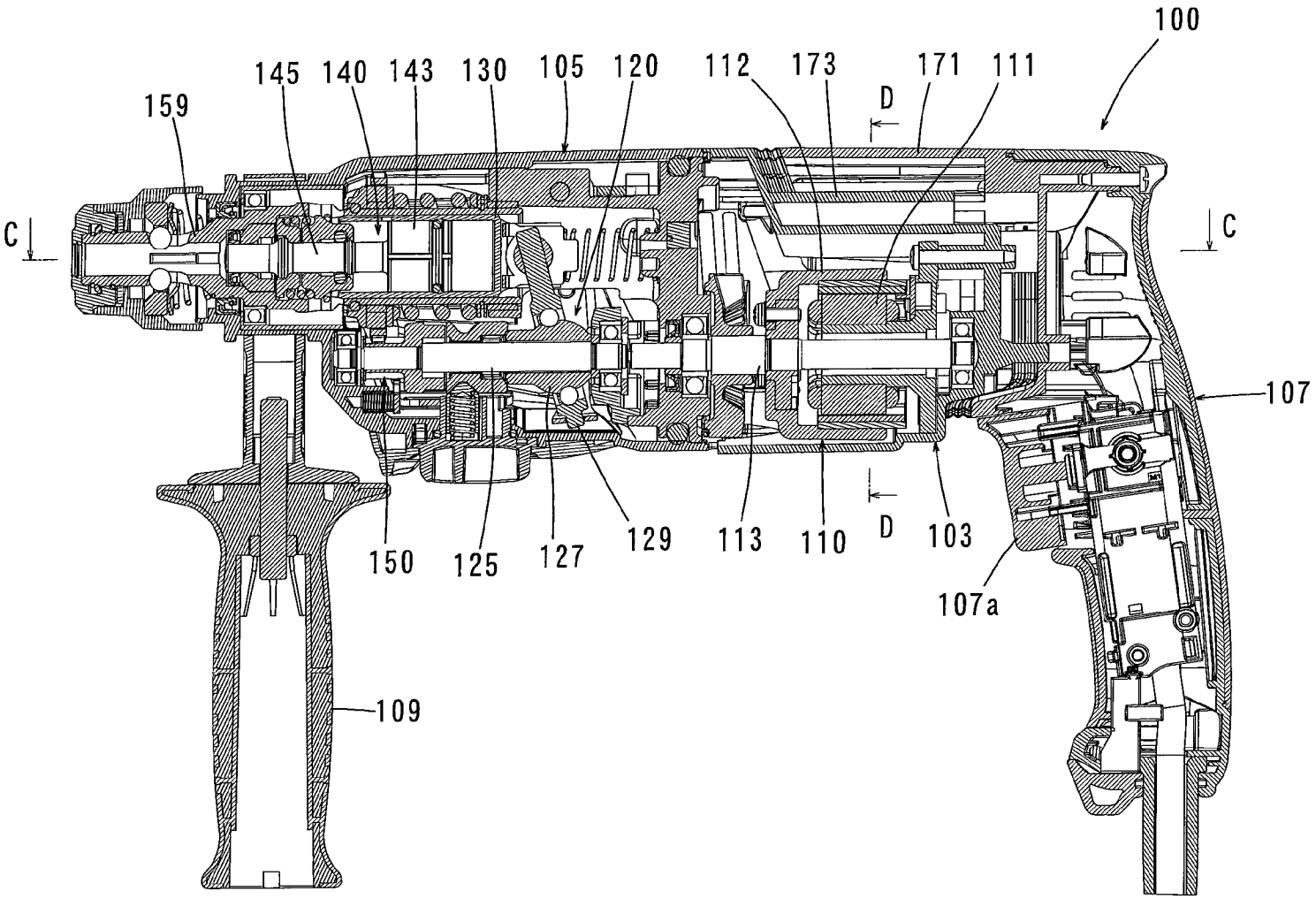
FIG. 6 is a cross sectional view that shows the configuration of a power hammer drill according to a third embodiment.

Next, a third embodiment of the present invention will be explained while referencing FIG. 6 through FIG. 8. The power hammer drill 100 according to the present embodiment is a modified example of the second embodiment, wherein, instead of the dynamic vibration absorbers 160, vibration-preventing springs 179 for the hand grip are disposed in the empty area inside the motor housing 103 above the electric motor 110. That is, an outer rotor type motor is used as the electric motor 110, wherein, as shown in FIG. 6, the motor shaft 113 is disposed coaxially with and directly coupled to the intermediate shaft 125 of the motion converting mechanism 120. Thereby, because the empty area is formed upward of the electric motor 110 and in the rearward direction of the impact axis line, the present embodiment adopts a configuration in which the vibration-preventing springs 179 are disposed in the empty area along the impact axis line in a side view. The vibration-preventing springs 179 correspond to a "prescribed functional member for a processing operation" and to an "elastic body" of the present invention.

Figure 8:
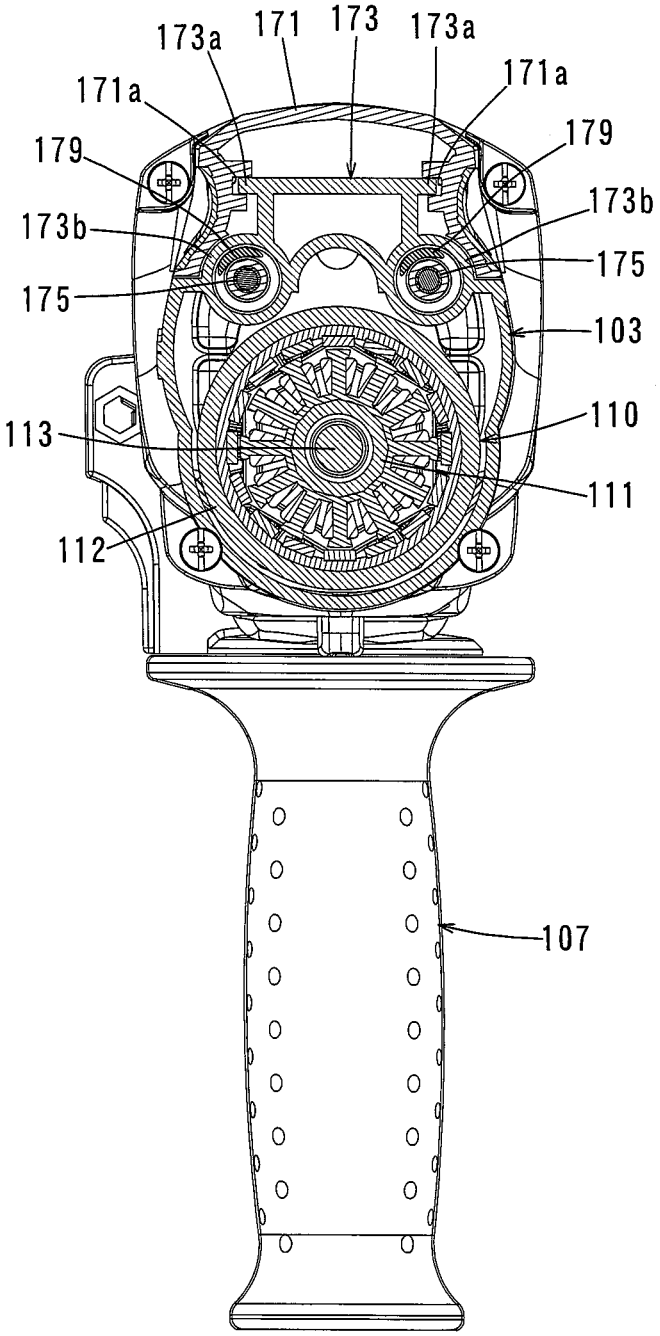
FIG. 8 is a cross sectional view taken along the D-D line in FIG. 6.

As shown in FIG. 6, the hand grip 107 comprises an upper part cover 171 that extends forward such that it covers the motor housing 103 from above; furthermore, as shown in FIG. 8, substantially U-shaped recessed parts 171*a*, which extend linearly in the longitudinal axis direction of the hammer bit 119, are formed on left and right inner sides of the upper part cover 171. A guide member 173 for connecting to the hand grip 107 is provided in the motor housing 103 in the empty area upward of the electric motor 110. The guide member 173 comprises left and right protruding parts 173*a*, which the recessed parts 171*a* of the upper part cover 171 slidably engage, and the hand grip 107 is connected so as to be relatively movable with respect to the motor housing 103 in the longitudinal axis direction of the hammer bit 119. Furthermore, the recessed parts 171*a* may be provided on the guide member 173, and the protruding parts 173*a* may be provided on the upper part cover 171.

Figure 7:
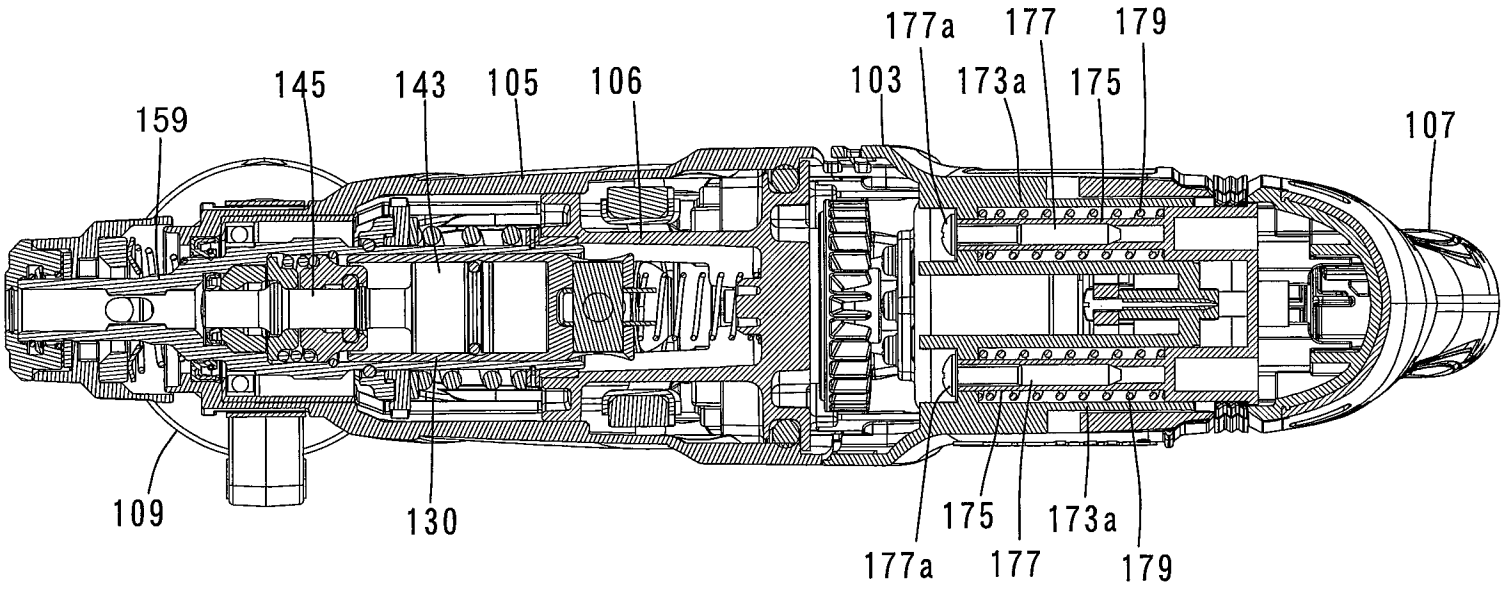
FIG. 7 is a cross sectional view taken along the C-C line in FIG. 6.

In addition, as shown in FIG. 7 and FIG. 8, the guide member 173 comprises two circular-cylindrical guide parts 173*b*, one on the left and one on the right, that are disposed downward of the protruding parts 173*a* and that extend linearly in the longitudinal axis direction of the hammer bit 119; furthermore, the cylindrical guide parts 173*b* slidably support rod-shaped members 175, which are circular in a cross section and are provided on the hand grip 107. That is, the guide member 173 is provided as a connecting member that connects the hand grip 107 to the motor housing 103 and is provided integrally with the left and right protruding parts 173*a* and with the left and right cylindrical guide parts 173*b*. Furthermore, the left and right cylindrical guide parts 173*b* are disposed parallel to one another such that they sandwich the impact axis line of the hammer bit 119 and are disposed along the impact axis line in a side view. In addition, the left and right protruding parts 173*a* are disposed parallel to one another such that they sandwich the impact axis line of the hammer bit 119 and are disposed upward of the impact axis line in a side view.

The rod shaped members 175 of the hand grip 107 are inserted, from the rear, into the cylindrical holes of the cylindrical guide parts 173*b* of the guide member 173, and the front end parts and the rear end parts of the rod shaped members 175 are slidably fitted in the cylindrical holes of the cylindrical guide parts 173*b*. Stopper screws 177 are screwed into the guide members 173 from the front end of the guide members 173; furthermore, head parts 177*a* of the stopper screws 177 make contact with end surfaces of the cylindrical guide parts 173*b* in the radial directions; the rod shaped members 175 are thereby retained by the cylindrical guide parts 173*b*.

An annular space is provided between the inner circumferential surface of each of the cylindrical guide parts 173*b* and the outer circumferential surface of the corresponding rod shaped member 175 so that the annular space spans a prescribed length in the axial direction, and the corresponding vibration-preventing spring 179 is housed in that annular space. Each of the vibration-preventing springs 179 is configured as a compression coil spring, wherein one end in the axial direction makes contact with its corresponding cylindrical guide part 173*b*, and the other end makes contact with its corresponding rod shaped member 175. Thereby, the vibration-preventing springs 179 exert urging forces onto the hand grip 107 in the direction rearward and away from the motor housing 103.

Thus, in the present embodiment, the hand grip 107 is elastically coupled to the motor housing 103 via the vibration-preventing springs 179. Constituent elements other than those described above are the same as those in the second embodiment, and consequently identical constituent members are assigned the same symbols as in the second embodiment and explanations thereof are therefore omitted or simplified.

According to the present embodiment configured as described above, because the hand grip 107 is elastically coupled to the motor housing 103 via the left and right vibration-preventing springs 179, the transmission of vibrations, which are generated in the main body part 101 during a processing operation, to the hand grip 107 can be isolated or attenuated by the vibration-preventing springs 179. Furthermore, an outer rotor type motor is used as the electric motor 110. Consequently, as in the case of the first embodiment discussed above, the tool body can be made compact and lightweight, and thereby operational effects, such as improved ease of operation, can be achieved.

In addition, the present embodiment adopts a configuration in which the vibration-preventing springs 179 are disposed inside the motor housing 103 along the impact axis line in a side view, and thus the relative motion of the hand grip 107 with respect to the motor housing 103 is stabilized when a processing operation is performed by pressing the hammer bit 119 against the workpiece. In this manner, the vibration-preventing function of the vibration-preventing springs 179 can be efficiently utilized.

In addition, the present embodiment adopts a configuration in which the left and right vibration-preventing springs 179 are disposed in a range that, when viewing the power hammer drill 100 from below and transverse to the longitudinal axis directions of the hammer bit 119 in FIG. 8, is not visible due to the electric motor 110. That is, a configuration is adopted wherein the entirety of each of the vibration-preventing springs 179 is disposed such that it is hidden behind the electric motor 110. Here, in the present embodiment, because an outer rotor type motor of the type, in which the stator 111 and the rotor 112 are disposed directly in the motor housing 103, is used as the electric motor 110, the vibration-preventing springs 179 are disposed such that they are hidden behind the rotor 112 of the electric motor 110. Furthermore, the phrase "the entirety thereof is hidden behind the electric motor 110" literally includes the type in which the entirety of each of the vibration-preventing springs 179 is hidden behind the electric motor 110, and preferably includes the type in which substantially the entirety of each of the vibration-preventing springs 179 is hidden behind the electric motor 110. Disposing the vibration-preventing springs 179 in this manner makes it possible to make the outer wall shape more compact in the direction orthogonal to the plane that includes both the axis line of the hammer bit 119 and the axis line of the motor shaft 113, even though it is a configuration that disposes the vibration-preventing springs 179. Furthermore, a configuration may be adopted in which at least a portion of each of the vibration-preventing springs 179 is disposed such that it is located in a range that, when the power hammer drill 100 is viewed from the side and orthogonally to the plane that includes both the axis line of the hammer bit 119 and the axis line of the motor shaft 113, is not visible due to the electric motor 110, i.e. a configuration in which at least a portion of each of the vibration-preventing springs 179 is disposed such that it is hidden behind the electric motor 110. Furthermore, in this case, substantially the entirety of each of the vibration-preventing springs 179 is preferably disposed such that it is hidden behind the electric motor 110. Adopting this configuration makes it possible to make the outer wall shape compact in the direction orthogonal to both the axis line of the hammer bit 119 and the axis line of the motor shaft 113.

Fourth Embodiment of the Present Invention

Figure 9:
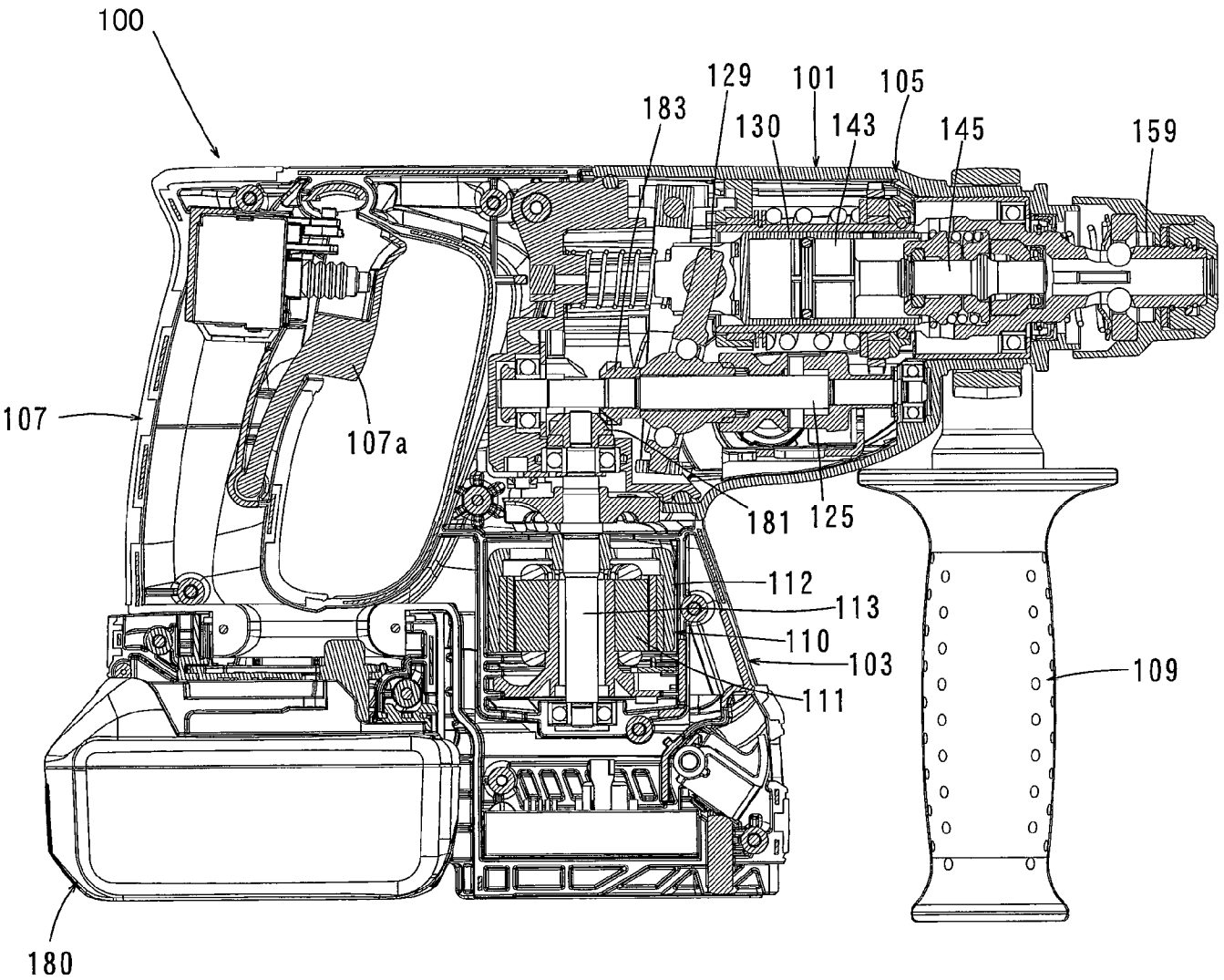
FIG. 9 is a cross sectional view that shows the configuration of a power hammer drill according to a fourth embodiment.

Next, a fourth embodiment of the present invention will be explained while referencing FIG. 9. The present embodiment is a case in which the present invention is adapted to a power hammer drill 100 that is L-shaped in side view and wherein the longitudinal axis of the hammer bit 119 and the axis line of the motor shaft 113 of the electric motor 110 are disposed in a cross shape. The power hammer drill 100 according to the present embodiment comprises the hand grip 107, the upper end and the lower end of which are connected to the main body part 101; furthermore, a battery pack 180, which is the drive power source of the electric motor 110, is removably attached to a lower end part of the hand grip 107. The hand grip 107 is configured as a D-shaped main handle in side view.

As illustrated, in the representative example of the L-shaped power hammer drill 100, the electric motor 110 is disposed in a lower area of the main body part 101. As in each of the embodiments discussed above, the electric motor 110 is configured as an outer rotor type motor in which the rotor 112 is disposed on the (radially) outer side of the stator 111. Furthermore, specific constituent elements of the outer rotor type motor are assigned the same symbols as in each of the embodiments described above, and explanations thereof are therefore omitted.

The motor shaft 113 of the electric motor 110 intersects (is orthogonal to) the intermediate shaft 125 and is coupled to the intermediate shaft 125 via two bevel gears 181, 183. That is, a drive bevel gear 181 that rotates integrally with the motor shaft 113 is provided at a tip (upper end) of the motor shaft 113, and the drive bevel gear 181 meshes with and thereby engages a rear end of the intermediate shaft 125; a driven bevel gear 183, which rotates integrally with the intermediate shaft 125, is provided. Furthermore, the two bevel gears 181, 183 are configured such that their speed reduction ratio is 1. That is, the motor shaft 113 and the intermediate shaft 125 are configured such that they are rotationally driven at a uniform speed. Furthermore, the intermediate shaft 125 is disposed parallel to the axis line of the hammer bit 119. Constituent elements of the power hammer drill 100 other than those described above are substantially the same as in the first embodiment discussed above, and consequently identical constituent members are assigned the same symbols, and explanations thereof are therefore omitted.

In the case of the L-shaped power hammer drill 100, the electric motor 110 is disposed in the lower area of the main body part 101. Furthermore, in the case of conventional power hammer drills in which the electric motor is configured as an inner rotor type motor, the required impact force is ensured by increasing the torque by reducing the rotational speed of the motor shaft via the drive bevel gear and the driven bevel gear disposed between the motor shaft and the intermediate shaft. Consequently, the outer diameter of the driven bevel gear increases, and the electric motor 110 is positioned lower to that extent; as a result, the position of the center of gravity of the power hammer drill 100 is farther from the longitudinal axis of the hammer bit 119, i.e. farther from the impact axis line; therefore, during a processing operation, the reaction (the moment around the center of gravity) received from the workpiece side increases, making operation more difficult, which is a disadvantage.

However, in the present embodiment, the electric motor 110 is configured as an outer rotor type motor, and this makes it possible to ensure the required impact force even if the rotational speed of the motor shaft 113 is not reduced when the rotational output is transmitted from the motor shaft 113 of the electric motor 110 to the intermediate shaft 125. Consequently, the outer diameter of the driven bevel gear 183 can be smaller, the electric motor 110 can be disposed closer to the impact axis line, and the position of the center of gravity of the power hammer drill 100 can be brought close to the impact axis line. Thereby, during a processing operation, the reaction (the moment around the center of gravity) received from the workpiece side can be reduced, which improves the ease of operation.

In addition, according to the present embodiment, the electric motor 110 is configured as an outer rotor type motor, and therefore, similar to in the first embodiment discussed above, the tool body can be made more compact and lightweight, and operational effects such as the improvement of the ease of operation can be achieved.

Furthermore, in the above-described embodiments cases were explained in which the dynamic vibration absorbers 160 and the vibration-preventing springs 179 serve as "functional members" that are disposed in the empty area upward of the electric motor 110, but the present invention is not limited thereto. For example, it is also possible to dispose a hook as the functional member that is used, for example, when storing the power hammer drill 100 on a wall, when transporting the power hammer drill 100 hooked onto a prescribed area, etc.

In addition, in each of the embodiments described above, a configuration is adopted wherein, by coaxially disposing the motor shaft 113 and the intermediate shaft 125, the dynamic vibration absorbers 160, the vibration-preventing springs 179, etc. are disposed in the empty area that is formed inside the motor housing 103; however, at least a portion of the dynamic vibration absorbers 160, the vibration-preventing springs 179, etc. should be disposed on the inner side of the outer contour of the electric motor 110 (the inner side of the outermost diameter part of the rotor 112), i.e., such that it is hidden behind the electric motor 110; furthermore, the motor shaft 113 and the intermediate shaft 125 do not have to be coaxial.

In addition, in the configuration in which the motor shaft 113 and the intermediate shaft 125 are disposed coaxially, the present embodiment adopts a configuration in which the motor shaft 113 and the intermediate shaft 125 are directly coupled; however, the two shafts 113, 125 may be formed integrally.

In addition, although the present embodiments described the case of a motor driven type hammer drill 100 as one example of the impact tool, the present embodiments may be adapted to power hammers in which the hammer bit 119 only carries out a linear movement.

Correspondence Relationships Between Constituent Elements of the Embodiments and Constituent Elements of the Present Invention The present embodiment describes one example of a mode for carrying out the present invention. Accordingly, the present invention is not limited to the configurations of the present embodiments. Furthermore, the correspondence relationships between the constituent elements of the present embodiments and the constituent elements of the present invention are described below.

The main body part 101 is one example of a configuration that corresponds to a "tool main body" of the present invention.

The hammer bit 119 is one example of a configuration that corresponds to a "tool bit" of the present invention.

The hand grip 107 is one example of a configuration that corresponds to a "handle" of the present invention.

The electric motor 110 is one example of a configuration that corresponds to a "motor" of the present invention.

The motor shaft 113 is one example of a configuration that corresponds to an "output shaft" of the present invention.

The intermediate shaft 125 is one example of a configuration that corresponds to a "drive shaft" of the present invention.

The oscillating ring 129 is one example of a configuration that corresponds to an "oscillating member" of the present invention.

The vertically-oriented wall part 106*a* of the inner housing 106 is one example of a configuration that corresponds to a "single bearing support member" of the present invention.

The bearing 117 is one example of a configuration that corresponds to a "first bearing" of the present invention.

The bearing 125*b* is one example of a configuration that corresponds to a "second bearing" of the present invention.

Each of the dynamic vibration absorbers 160 is one example of a configuration that corresponds to a "prescribed functional member for processing operations" of the present invention.

Each of the vibration-preventing springs 179 is one example of a configuration that corresponds to a "prescribed functional member for a processing operation" of the present invention.

Each of the vibration-preventing springs 179 is one example of a configuration that corresponds to an "elastic body" of the present invention.

In consideration of the above object of the present invention, a work tool according to the present invention can be configured in accordance with the aspects below.

(First Aspect)

"An impact tool that performs a prescribed processing operation on a workpiece by carrying out an impact operation on a tool bit in a longitudinal axis direction, comprising:

a motor, which comprises a rotor and a stator;

a tool main body, which houses the motor;

a drive shaft, which is disposed parallel to a longitudinal axis of the tool bit and is rotatably driven by the motor;

an oscillating member, which is supported by the drive shaft and carries out an oscillating movement in the axial direction of the drive shaft based on the rotational motion of the drive shaft; and a tool drive mechanism, which is coupled to the oscillating member and linearly moves the tool bit in the longitudinal axis direction by the oscillating movement of the oscillating member, thereby linearly driving the tool bit;

wherein, the motor is configured as an outer rotor type motor in which the rotor is disposed on an outer side of the stator."

(Second Aspect)

"An impact tool according to the first aspect, wherein the drive shaft is configured such that it is driven at the same rotational speed as the output shaft of the motor."

(Third Aspect)

"An impact tool according to the first or second aspect, comprising:

a first bearing, which rotationally supports the output shaft of the motor; and a second bearing, which rotationally supports the drive shaft;

wherein, the first bearing and the second bearing are supported by the tool main body via a single bearing support member."

(Fourth Aspect)

"An impact tool according to any one aspect of the first through third aspects, wherein the output shaft of the motor and the drive shaft are disposed coaxially."

(Fifth Aspect)

"An impact tool according to any one aspect of the first through fourth aspects, wherein the longitudinal axis of the tool bit and the drive shaft are disposed in parallel and spaced apart by a prescribed distance in a direction that intersects the extension direction of the longitudinal axis; and at least a portion of a prescribed functional member for the processing operation is disposed on an inner side of a projection range of the motor in a virtual projection plane when viewed from one side of a direction along a straight line that is a straight line along a plane containing both the longitudinal axis of the tool bit and the drive shaft, which straight line intersects the longitudinal axis of the tool bit."

(Sixth Aspect)

"An impact tool according to any one aspect of the first through fifth aspects, wherein the longitudinal axis of the tool bit and the drive shaft are disposed in parallel and spaced apart by a prescribed distance in a direction that intersects the extension direction of the longitudinal axis; and at least a portion of a prescribed functional member for the processing operation is disposed on an inner side of a projection range of the motor in a virtual projection plane when viewed from a direction along a straight line that is a straight line, which is orthogonal to a plane containing both the longitudinal axis of the tool bit and the drive shaft, which straight line intersects the longitudinal axis of the tool bit."

(Seventh Aspect)

"An impact tool according to the fifth or sixth aspect, wherein the functional member is a vibration-preventing mechanism for reducing vibrations of the tool main body."

(Eighth Aspect)

"An impact tool according to the fifth or sixth aspect, comprising:

a handle for the operator to grasp coupled to the tool main body;

wherein, the functional member is an elastic body that couples the tool main body and the handle."

(Ninth Aspect)

"An impact tool according to the fifth or sixth aspects, comprising:

a handle for the operator to grasp;

wherein, the handle is coupled to the tool main body; and the functional member is an elastic body that couples the tool main body and the handle."

(Tenth Aspect)

"An impact tool according to the second aspect, wherein the output shaft of the motor and the drive shaft are arranged in a cross-shaped with each other and are coupled by bevel gears."

EXPLANATION OF THE SYMBOLS

100 Power hammer drill (impact tool)
101 Main body part (tool main body)
103 Motor housing
103*a* Rearward vertically-oriented wall part
105 Gear housing
106 Inner housing
106*a* Vertically-oriented wall part (singular bearing support member)
107 Hand grip (handle)
107*a* Trigger
109 Side grip
110 Electric motor (motor)
111 Stator
111*a* Drive coil
111*b* Coil holding member
111*c* Mounting flange member
112 Rotor
113 Motor shaft (output shaft)
114 Screw
115 Magnet
116 Bearing
117 Bearing (first bearing)
119 Hammer bit (tool bit)
120 Motion converting mechanism
121 Drive gear
123 Driven gear
125 Intermediate shaft (drive shaft)
125*a* Bearing
125*b* Bearing (second bearing)
127 Rotary body
128 Ball
129 Oscillating ring (oscillating member)
129*a* Oscillating rod
130 Cylindrical piston (tool drive mechanism)
130*a* Air chamber
131 Coupling shaft
133 O-ring
135 Oil seal
140 Impact element
143 Striker (tool drive mechanism)
145 Impact bolt (tool drive mechanism)
150 Power transmitting mechanism
151 First transmitting gear
153 Second transmitting gear
159 Tool holder
160 Dynamic vibration absorber (functional member and vibration-preventing mechanism)
161 Cylindrical body
163 Weight
165 Urging spring
167 Guide sleeve
169 Spring retainer
171 Upper part cover
171*a* Recessed part
173 Guide member
173*a* Protruding part
173*b* Cylindrical guide part
175 Rod shaped member
177 Stopper screw
177*a* Head part
179 Vibration-preventing spring (functional member and elastic body)
180 Battery pack
181 Drive bevel gear
183 Driven bevel gear

The invention claimed is:

1. An impact tool that performs a prescribed processing operation on a workpiece by carrying out an impact operation on a tool bit in a longitudinal axis direction, comprising:

a tool main body having a front and a rear and a left side and a right side and a top and a bottom;

a tool bit holder located at the front of the tool main body and configured to hold the tool bit;

an outer-rotor motor housed in the tool main body, the motor comprising a stator and a rotor disposed on an outer side of the stator;

a motor output shaft configured to be rotated by the rotor, the motor output shaft extending in a front-rear direction and being disposed parallel to and below an extension line of a longitudinal axis of the tool bit, the motor output shaft being spaced from the extension line by a prescribed distance;

a drive shaft disposed coaxially with the motor output shaft and extending in the front-rear direction, the drive shaft being configured to be rotatably driven by the motor output shaft;

an oscillating member supported by the drive shaft and configured to carry out an oscillating movement in the axial direction of the drive shaft based on the rotational motion of the drive shaft;

a tool drive mechanism coupled to the oscillating member and configured to linearly move the tool bit in the longitudinal axis direction by the oscillating movement of the oscillating member, thereby linearly driving the tool bit; and a vibration-preventing mechanism for reducing vibrations of the tool main body, the vibration-preventing mechanism at least partially overlapping the motor in the front-rear direction when viewed from the right side of the tool main body and at least partially overlapping the motor in a left-right direction when viewed from the top of the tool main body and at least partially overlapping the motor in a top-bottom direction when viewed from the right side of the tool main body.

2. The impact tool according to claim 1, wherein the drive shaft is configured to be driven at the same rotational speed as an output shaft of the motor.

3. The impact tool according to claim 1, further comprising:

a first bearing rotationally supporting the output shaft of the motor; and a second bearing rotationally supporting the drive shaft; wherein, the first bearing and the second bearing are supported by the tool main body via a single bearing support member.

4. The impact tool according to claim 1, wherein the vibration-preventing mechanism comprises a dynamic vibration absorber.

5. The impact tool according to claim 1, further comprising:

a handle for the operator to grasp;

wherein, the handle is coupled to the tool main body by an elastic body.

6. The impact tool according to claim 1, wherein the vibration-preventing mechanism at least partially overlaps an extension of the longitudinal axis of the tool bit when viewed from the right side of the tool main body.

7. An impact tool configured to perform a processing operation on a workpiece by an impact operation on a tool bit in a direction of a longitudinal axis of the tool bit, the impact tool comprising:

a tool main body having a front and a rear and a left side and a right side and a top and a bottom;

a tool bit holder located at the front of the tool main body and configured to hold the tool bit;

an outer rotor motor in the tool main body, the motor including a stator and a rotor disposed on an outer side of the stator;

a motor output shaft configured to be rotated by the rotor, the motor output shaft including an end and extending in a front-rear direction;

a drive shaft having an end and being operably connected to the motor output shaft so as to rotate at the same speed as the motor output shaft;

an oscillating member operably coupled to the drive shaft such that rotary motion of the drive shaft oscillates the oscillating member in a linear direction;

a tool drive mechanism operably coupled to the oscillating member and configured to be moved in the front-rear direction by the oscillating member; and a vibration-preventing mechanism for reducing vibrations of the tool main body, the vibration-preventing mechanism at least partially overlapping the motor in the front-rear direction when viewed from the right side of the tool main body and at least partially overlapping the motor in a left-right direction when viewed from the top of the tool main body, and at least partially overlapping the motor in a top-bottom direction when viewed from the right side of the tool main body.

8. The impact tool according to claim 7, further including a drive gear at the end of the motor output shaft and a driven gear at the end of the drive shaft, wherein the drive gear and the driven gear overlap in the front-rear direction.

9. The impact tool according to claim 7, further including a unitary support member supporting the end of the drive shaft and the end of the motor output shaft.

10. The impact tool according to claim 7 further including:

a unitary support member;

a first bearing supported by the unitary support member and rotationally supporting the motor output shaft; and a second bearing supported by the unitary support member and rotationally supporting the drive shaft.

11. The impact tool according to claim 10, wherein the unitary support member extends from a top of the tool main body to a bottom of the tool main body and partitions the tool main body into first and second compartments.

12. The impact tool according to claim 7, wherein a longitudinal axis of the drive shaft extends in the front-rear direction.

13. The impact tool according to claim 7, wherein a longitudinal axis of the motor output shaft is offset from and parallel to a longitudinal axis of the drive shaft.

14. The impact tool according to claim 13, wherein the longitudinal axis of the tool bit is offset from and parallel to the longitudinal axis of the drive shaft and is offset from and parallel to the longitudinal axis of the motor output shaft.

15. The impact tool according to claim 7, wherein the motor output shaft and the drive shaft are coaxial.

16. The impact tool according to claim 7, wherein the vibration-preventing mechanism comprises a dynamic vibration absorber.

17. The impact tool according to claim 7, further including a handle configured to be grasped by a worker, the handle being coupled to the tool main body by an elastic body.

18. The impact tool according to claim 7, wherein the vibration-preventing mechanism at least partially overlaps an extension of the longitudinal axis of the tool bit when viewed from the right side of the tool main body.

19. An impact tool that performs a prescribed processing operation on a workpiece by carrying out an impact operation on a tool bit in a longitudinal axis direction, comprising:

a tool main body having a front and a rear and a left side and a right side and a top and a bottom;

a tool bit holder located at the front of the tool main body and configured to hold the tool bit;

an outer-rotor motor housed in the tool main body, the motor comprising a stator and a rotor disposed on an outer side of the stator;

a motor output shaft configured to be rotated by the rotor, the motor output shaft extending in a front-rear direction and being disposed parallel to and below an extension line of a longitudinal axis of the tool bit, the motor output shaft being spaced from the extension line by a prescribed distance;

a drive shaft extending in the front-rear direction and configured to be rotatably driven by the motor output shaft;

an oscillating member supported by the drive shaft and configured to carry out an oscillating movement in the axial direction of the drive shaft based on the rotational motion of the drive shaft;

a tool drive mechanism coupled to the oscillating member and configured to linearly move the tool bit in the longitudinal axis direction by the oscillating movement of the oscillating member, thereby linearly driving the tool bit; and a vibration-preventing mechanism for reducing vibrations of the tool main body, the vibration-preventing mechanism at least partially overlapping the motor in the front-rear direction when viewed from the right side of the tool main body and at least partially overlapping the motor in a left-right direction when viewed from the top of the tool main body and at least partially overlapping the extension of the longitudinal axis of the tool bit when viewed from the right side of the tool main body.

20. The impact tool according to claim 19, wherein the drive shaft is disposed coaxially with the motor output shaft.

* * * * *